US005554044A

United States Patent [19]

Nishide

[11] Patent Number: 5,554,044

[45] Date of Patent: Sep. 10, 1996

[54] CONNECTOR

[75] Inventor: Satoru Nishide, Yokkaichi, Japan

[73] Assignee: Sumitomo Wiring Systems, Ltd., Mie, Japan

[21] Appl. No.: 498,337

[22] Filed: Jul. 5, 1995

[30] Foreign Application Priority Data

Jul. 13, 1994 [JP] Japan ..... 6-185476

[51] Int. Cl.[6] ..... H01R 13/627

[52] U.S. Cl. ..... 439/352; 439/372

[58] Field of Search ..... 439/489, 488, 439/350, 352, 372

[56] References Cited

U.S. PATENT DOCUMENTS

| | | | |
|---|---|---|---|
| 3,713,076 | 1/1973 | Gabrielian et al. . | |
| 4,674,814 | 6/1987 | Hishino et al. . | |
| 4,871,325 | 10/1989 | Maejima et al. . | |
| 4,941,839 | 7/1990 | Nagasaka et al. | 439/352 |
| 5,480,324 | 1/1996 | Maegawa et al. | 439/489 |

FOREIGN PATENT DOCUMENTS

| | | |
|---|---|---|
| 0483853A2 | 10/1991 | European Pat. Off. . |
| 1-165582 | 11/1989 | Japan . |
| 2264593 | 1/1993 | United Kingdom . |

*Primary Examiner*—Khiem Nguyen
*Assistant Examiner*—Yong Kim
*Attorney, Agent, or Firm*—Oliff & Berridge

[57] ABSTRACT

A connector comprises a female connector housing having a flexibly deformable lock arm, a male connector housing having a lock portion elastically engageable with the lock arm when the two connector housings are completely engaged with each other, and a lock holding member rotatably mounted at an end of the lock arm. The lock holding member is selectively movable between an unlock position to allow the lock arm to be flexed in an unlocking direction thereof and a lock position to inhibit the lock arm to be flexed in the unlocking direction. In the complete engagement state, if a lock holding member in the end of the lock arm is rotated from an unlock position to a lock position, then the lock arm is prevented from being deformed flexibly to thereby be able to keep on the locking state of the connector. On the other hand, when the female and male connector housings are in incomplete engagement with each other, the lock arm is on the way to its flexible deformation. In this state, since the lock holding member is unable to advance into the flexing side of the lock arm, an operator can know that the female and male connector housings are in incomplete engagement with each other, in accordance with the fact that the lock holding member cannot be shifted to the lock position.

7 Claims, 4 Drawing Sheets

CONNECTOR

BACKGROUND OF THE INVENTION

The present invention relates to a connector.

Conventionally, in order to lock the engagement between male and female connectors, there is known a connector in which a flexibly deformable lock arm is provided in one of female and male connector housings and an elastically engageable lock portion is provided in the other connector housing. An example of such connector is shown in FIG. 8. In the connector shown FIG. 8, a flexibly deformable lock arm 40 is provided in the upper surface of a female connector housing F, while in a male connector housing M there is provided an expansion portion 41 into which the lock arm 40 can be inserted and there are opened up in the expansion portion 41 a window portion 43 engageable with a pawl portion 42 included in the lock arm 40. Thus, when the two female and male connector housings F and M are in complete engagement with each other, the pawl portion 42 of the lock arm 40 is in engagement with the window portion 43 and, in this case, since the lock arm 40 is in a flexible state, there is a possibility that the engagement between the lock arm 40 and the expansion portion 41 can be removed. In view of this, in the shown example, a lock holding piece 44 having a U-like shape is inserted from the flank into the portion of the lock arm 40 projecting from the expansion portion 41 to prevent the lock arm 40 from being flexed, thereby keeping the engagement or locking between the two male and female connector housings M and F.

However, similarly to another conventional connector to be described below, the above conventional system has a so called half-engagement detecting function in order to prevent the two connector housings F and M from being delivered to the next step as they remain in incomplete engagement. That is, in the above connector, if the two connector housings are in half-engagement with each other, then the lock arm 40 remains flexed and thus the lock holding piece 44 cannot be inserted. An operator is able to know from this that the two connector housings are in half-engagement or in incomplete engagement.

In FIG. 9, there is shown another conventional system (which is disclosed in Japanese Utility Model Publication (Kokai) Hei-1-165582). In this connector as well, a lock arm 45 is provided in a female connector housing F and, if a projection 46 provided in the female housing F on the way to the lock arm 45 is engaged with a window portion 47 formed in a male connector housing M, then the two connector housings F and M can be locked. Also, in this connector, as shown in FIG. 9A, a lock holding member 48 is disposed in the rear of the leading end of the female housing F. After the two connector housings F and M are fitted with each other completely, as shown in FIG. 9B, if the lock holding member 48 is operated forwardly, then a projecting piece 49 provided on and projected from the lock holding member 48 is inserted into a lock groove 50 formed in the lock arm 45 to thereby prevent the lock arm 45 from flexing so as to be able to keep the locked state. If the two connector housings are in the half-engagement with each other, then the lock arm remains flexed to thereby cause the lock groove 50 and the projecting piece 49 not to coincide with each other, so that the projecting piece 49 cannot be inserted.

However, in the conventional system shown in FIG. 8, since the lock holding piece is formed as a separate member, the lock holding piece must be kept and controlled separately, which is disadvantageous in handling, for example, it is easy to lost. Also, because the lock arm must has a certain length dimension for mounting the lock holding piece and thus the whole length of the lock arm becomes unnecessarily long, there is a possibility that the lock arm can be hitched and damaged easily during the transportation thereof or the like. On the other hand, in the conventional system shown in FIG. 9, although the lock holding piece is formed integrally with the female connector housing, the lock holding member must be arranged such that the leading end of the projecting piece thereof is separated backwardly away from the lock groove so as not to interfere with the flexibly deforming operation of the lock arm. That is, since the interference avoiding dimension must be secured in the rear portion, the whole length of the housing must be made longer, or, as shown in FIG. 9. The lock holding member must be projected backwardly from the housing. In this structure, the housing is large in side or the housing is easily damaged due to the projected lock holding member.

SUMMARY OF THE INVENTION

The present invention aims at eliminating the drawbacks found in the above-mentioned conventional connectors. Accordingly, it is an object of the invention to provide a connector which is excellent in handling and is simple in structure. Also, it is another object of the invention to provide a connector which allows an operator to know incomplete engagement between connector housings easily.

In attaining the above objects, according to the invention, there is provided a connector in which a flexibly deformable lock arm is provided in one of male and female connector housings while there is provided in the other connector housing a lock portion elastically engageable with the lock arm when the two male and female connector housings are fitted with each other completely, in that a lock holding member is rotatably mounted on one of the two male and female connector housings and the lock holding member is structured such that it is shiftable between an unlock position to allow the lock arm to be flexed in the unlocking direction of the lock arm and a lock position to allow to advance to the flexing side of the lock arm to thereby prevent the lock arm from being flexibly deformed in the unlocking direction thereof.

Also, the lock holding member may be rotatably mounted on the free end side of the lock arm and may be structured such that, when it is situated at the unlock position, the lock holding member may cover a lock indication portion provided in the free end portion of the lock arm and, when it is situated at the lock position, it may expose the lock indication portion.

According to the invention, when the male and female connector housings are completely fitted with each other, the lock arm is in engagement with the lock portion of the other housing. In this state, if the lock holding member is rotated from the unlock position to the lock position, then the lock arm is prevented from being flexibly deformed, thereby being able to keep the locking state between the two connector housings.

When the male and female connector housings are not fitted with each other completely or in a half-engagement state, the lock arm is on the way to the flexible deformation thereof. In this state, since the lock holding member is impossible to advance into the flexing side of the lock arm, an operator can know the half-engagement state between the two connector housings from the fact that the lock arm cannot be shifted to the lock position.

Furthermore, in addition to the operation of the invention as above, if the lock holding member is rotated to the lock position, then the lock indication portion on the lock arm side is exposed but, for the half-engagement state, the lock indication portion will not be exposed completely.

The present invention provides the following effects: That is, since the lock holding member is formed integrally with one of the connector housings and is mounted in such a manner that it can be rotated at a given position, the dimension of the lock holding member in the longitudinal direction thereof is shortened when compared with the conventional one and thus it is compact in structure.

The lock indication portion, which is normally covered, is exposed due to the rotation of the lock holding member, if the lock indication portion is arranged noticeable, then it is easy to confirm visually whether the male and female connector housings are completely engaged with each other or not.

DETAILED DESCRIPTION OF PREFERRED EMBODIMENT

Now, description will be given below of an embodiment of a connector according to the invention with reference to FIGS. 1 to 7.

Figure 1:
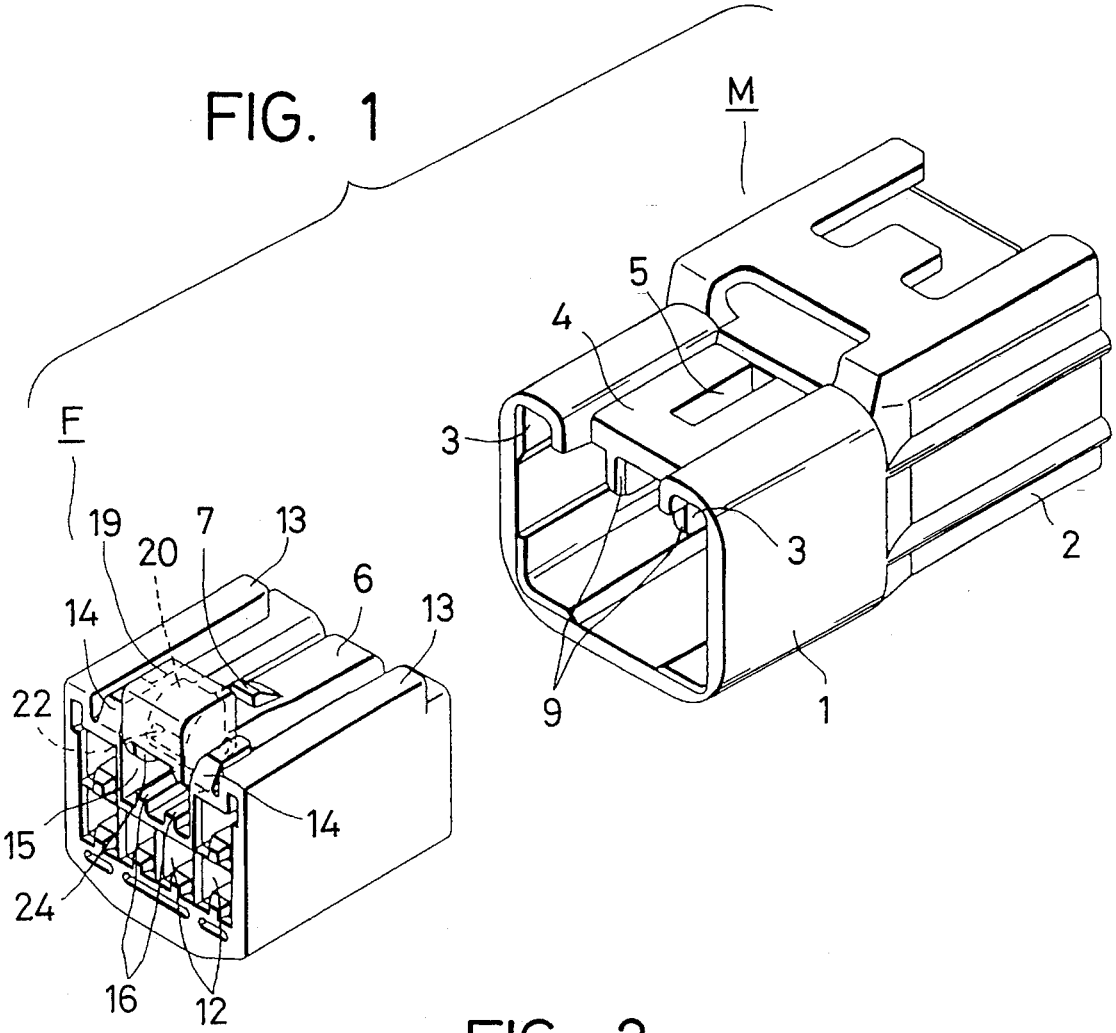
FIG. 1 is a perspective view of an embodiment of a connector according to the invention.

As shown in FIG. 1, the connector according to the present embodiment includes a pair of male and female connector housings M and F which can be fitted with each other. At first, description will be given of the male connector housing M.

The male connector housing M is formed of synthetic resin in an integral body. The male connector housing M includes in the front portion thereof a hood portion 1 opened forwardly for fitting with the female connector housing F and, in the rear portion thereof, a main body portion 2 formed continuous with the hood portion 1 for holding a plurality of male terminals. The male terminals are inserted into the main body portion 2 from behind, while the leading end portions of the respective male terminals are situated within the hood portion 1.

The hood portion 1 is formed in a substantially square cylinder, and the upper edge portions of the two right and left side walls of the hood portion 1 are respectively formed bent inwardly in a U shape to thereby produce two positioning groove portions 3 which are used to guide the hood portion 1 into engagement or fitting with the female connector housing F. Also, the portions of the hood portion 1 in which the two positioning groove portions 3 are disposed are connected to each other by a lock wall 4 which is used for locking the male connector housing M to the female connector housing F. The lock wall 4 is structured such that the upper surface thereof is lower than the right and left surface that are situated outside the upper surface, and also such that the leading end thereof also stands inwardly back from the right and left sides thereof. In the lock wall 4, there is formed a window portion 5 of a given length which extends through the lock wall 4 forwardly from the central portion of the end edge of the main body portion 2 side, while the window portion 5 is engageable with a lock projecting portion 7 formed in a lock arm 6 provided in the female housing F side. In the present embodiment, for smooth engaging operation with the lock arm 6, the front edge of the lock wall 4 is rounded off to thereby provide a chamfered portion 8 for guidance of the engagement (see FIG. 2). The lock wall 4 includes on the lower surface thereof a pair or right and left slide projecting pieces 9 which respectively hang down from the lower surface of the lock wall 4. The two slide projecting pieces 9 can be inserted into clearances included on the two sides of the lock arm 6 and, for smooth insertion, the front edges of the two slide projecting pieces 9 are respectively rounded into chamfered portions 11 (see FIG. 2).

On the other hand, similarly to the male connector housing M, the female connector housing F is formed of synthetic resin into an integral body and, as shown in FIG. 1, as a whole, it is formed in a substantially rectangular parallelepiped. And, the female housing F includes terminal storage chambers 12 corresponding in number to the male terminals (not shown) provided on the male housing M side. That is, in the present embodiment, the terminal storage chambers 12 are arranged in two upper and lower stages: in the lower stage, four chambers are arranged side by side to one another, while in the upper stage, two chambers are arranged spaced apart from each other. Female terminals (not shown) are respectively into their respective terminal storage chambers 12 and they can be electrically connected with one another if the male and female connector housings M and F are normally engaged with each other.

Also, in the right and left edge portions of the upper surface of the female connector housing F, there are projected a pair of guide projecting portions 13 which are respectively fittable into the two positioning groove portions 3 formed in the male connector housing M. Further, inside the rear end portions of the two projecting portions 13, there are projectingly formed two protection projecting portions 14 which are substantially as high as the guide projecting portions 13 and are used to protect the lock arm 6 to be discussed below.

Figure 2:
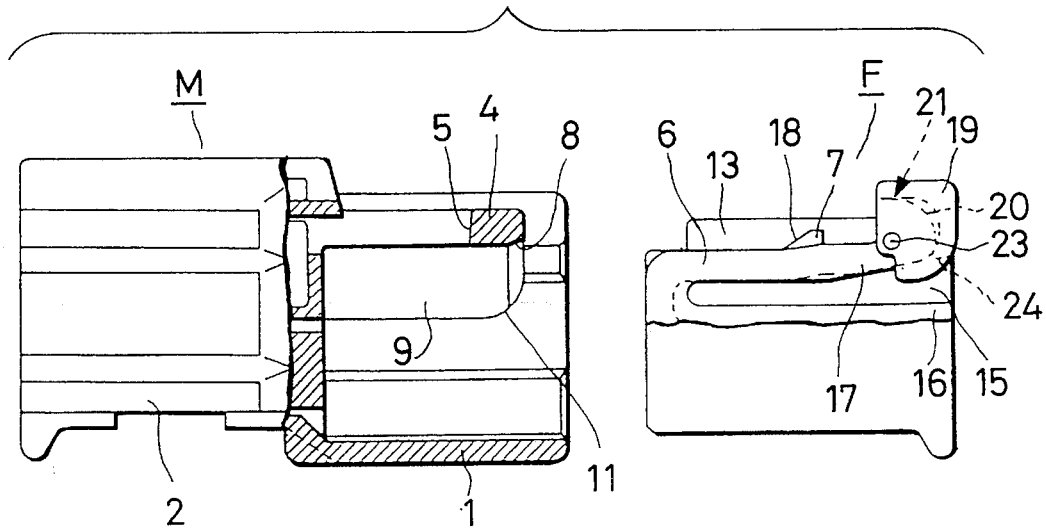
FIG. 2 is a partially cutaway side view of the above connector, showing a state thereof before male and female connector housings thereof are fitted with each other.
Figure 3:
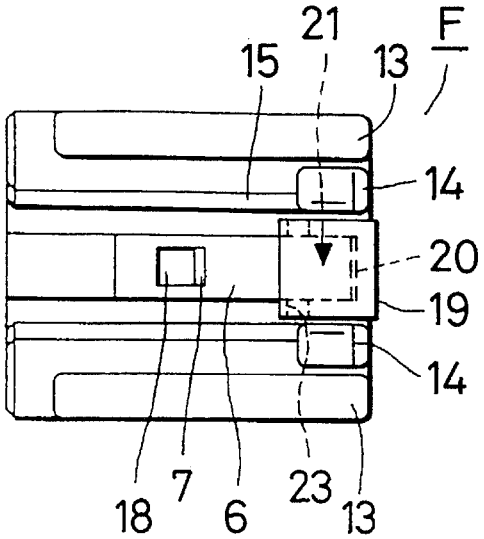
FIG. 3 is a top plan view of the female connector housing used in the above connector.
Figure 4:
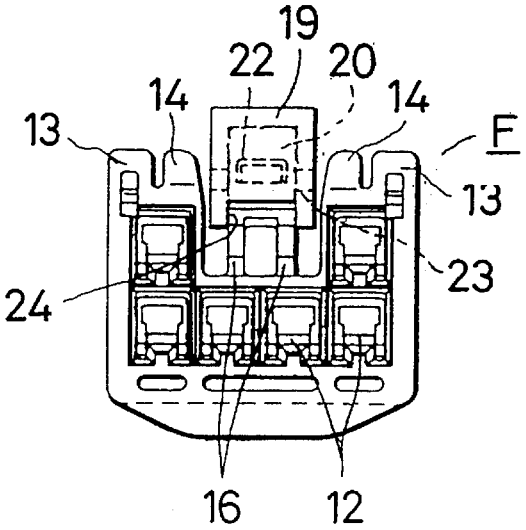
FIG. 4 is a back view of the female connector housing used in the connector.

In the central portion of the upper surface of the female connector housing F, there is formed a mounting recessed portion 15 in which the lock arm 6 is to be positioned. A pair of projecting strip portions 16 are projectingly formed on the bottom surface of the mounting recessed portion 15 along the longitudinal direction thereof. As shown in FIG. 2, the portions of the lock arm 6 on the one end side (the side which faces the male connector housing M) of the two projecting strip portions 16 are collected together and are turned back into a U-like shape which extends near the opposite side end portion of the female connector housing F. The leading end of the lock arm 6 is a free end which allows the whole of the lock arm 6 to be flexibly deformed in the vertical direction. Also in the central portion of the upper surface of the lock arm 6, there is formed a lock projecting portion 7 in such a manner that it is engageable with the window portion 5 formed on the male housing M side. And, in order to secure such an amount of flexure of the lock arm 6 as permits the above engagement, there is formed an escape portion 17 consisting of an inclined surface in the lower surface of the lock arm 6 on the free end side thereof, thereby preventing the lock arm 6 from interfering with the two projecting strip portions 16. However, the front surface of the lock projecting portion 7 provides an inclined surface 18 having an upgrade, which enables the lock projecting portion 7 to be engaged with the window portion 5 smoothly.

Further, the lock arm 6 includes in the leading end portion thereof a mounting projecting portion 20 for mounting a lock holding member 19 which is used to lock the female and male connector housings F and M. The mounting projecting portion 20 includes an arc surface in the back surface range thereof extending from the terminal end of the portion thereof, in which the escape portion 17 is formed, to the upper surface, while the front surface of the projecting portion 20 is cut down almost at right angles. And, the upper surface of the mounting recessed portion 20 provides a lock indication portion 21 which is used to indicate that the female and male housings F and M are locked to each other. In the present embodiment, the lock indication portion 21 is colored with a different color from the remaining portions of the housing. However, this is not limitative but a color tape may be applied onto the lock indication portion 21. Here, the mounting projecting portion 20 includes a through hole 22 which extends through the projecting portion 20 in the longitudinal direction thereof. This through hole 22 is formed in relation to the formation of the lock projecting portion 7.

Figure 5:
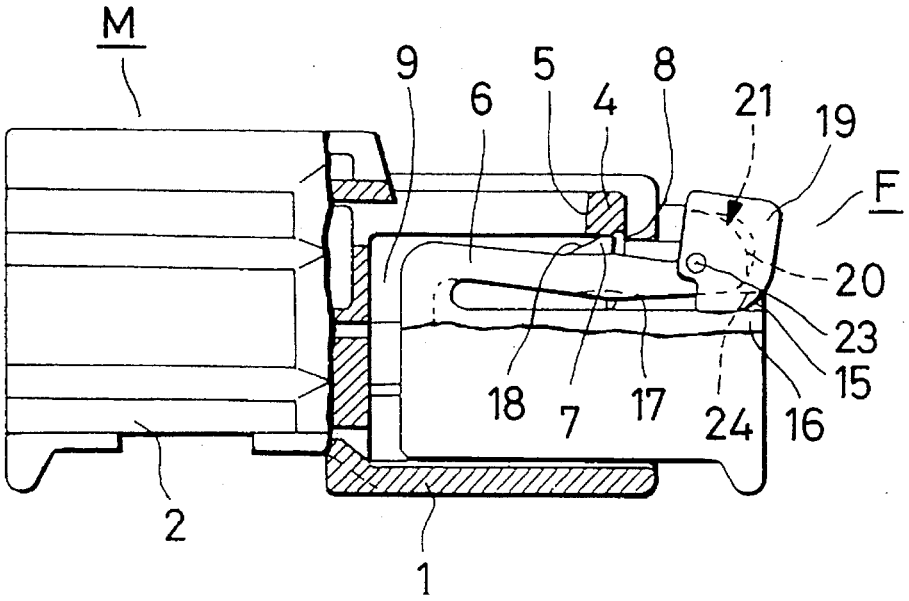
FIG. 5 is a partially cutaway side view of the above connector, showing a state thereof in which the male and female connector housings are on the way to their mutual engagement.
Figure 6:
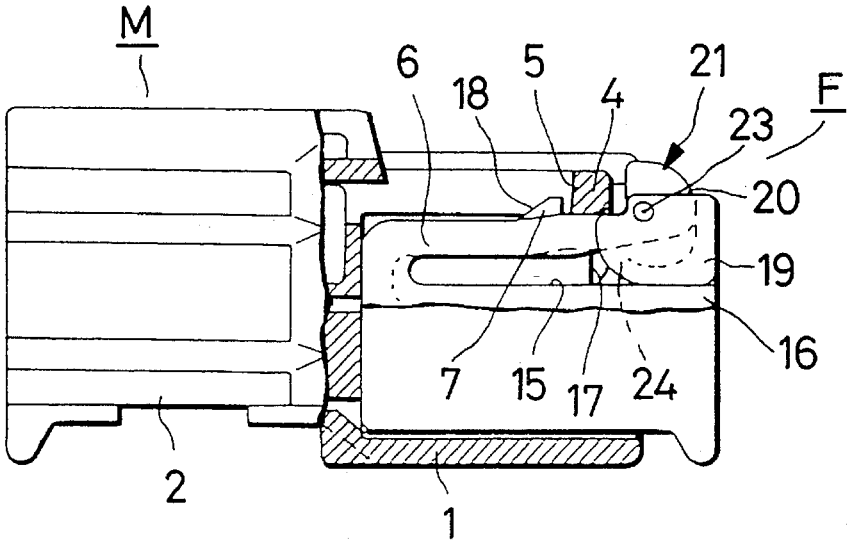
FIG. 6 is a partially cutaway side view of the above connector, showing a state thereof in which the male and female connector housings are in engagement with each other.
Figure 7:
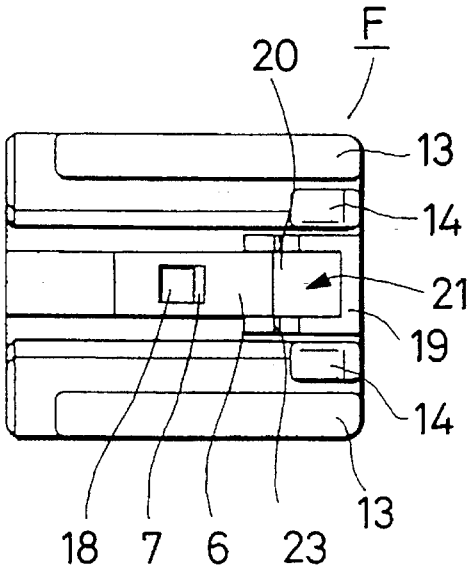
FIG. 7 is a top plan view of the female connector housing of the above connector with a lock indication portion thereof exposed.
Figure 8:
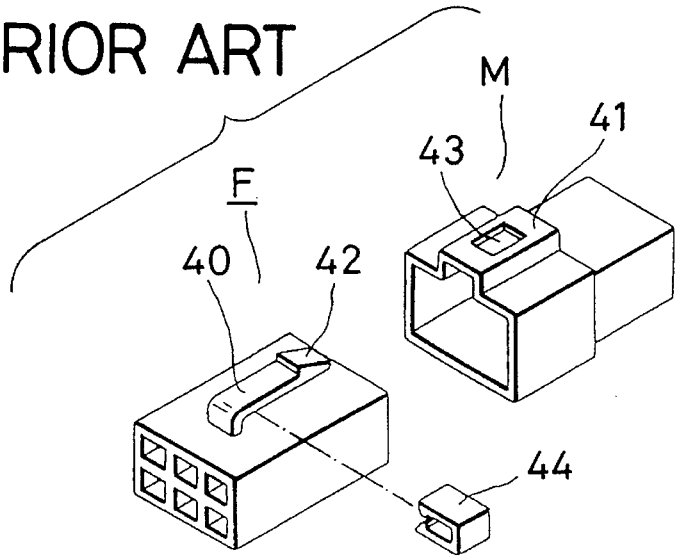
FIG. 8 PRIOR ART
FIG. 8 is a perspective view of a conventional connector.
Figure 9A:
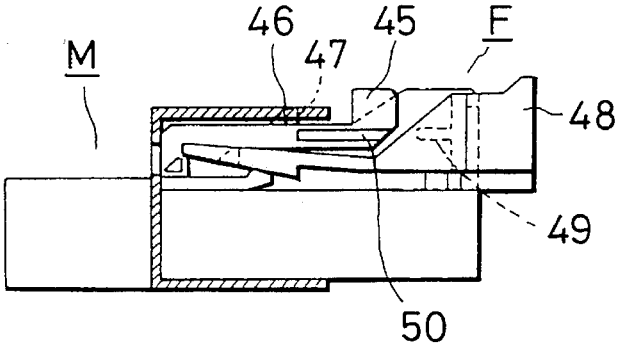
FIG. 9A PRIOR ART
FIGS. 9A and 9B are prospective views is of another conventional connector.
Figure 9B:
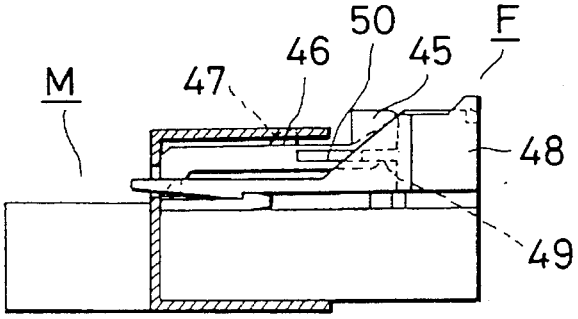
FIG. 9B PRIOR ART

Now, a rotary shaft 23 is projectingly formed integrally on the two side surface of the mounting projecting portion 20 such that it extends outwardly from the two side surfaces of the projecting portion 20. Due to the rotary shaft 23, a lock holding member 19 is mounted in such a manner that it can be rotated. The lock holding member 19 is formed in a box shape which encloses the upper surface, two side surfaces and back surface of the mounting recessed portion 20, while the inner surface of the lock holding member 19 provides an arc surface shape which corresponds to the arc surface extending from the back surface of the mounting projecting portion 20 to the upper surface thereof. And, the lock holding member 19, in a normal state as shown in FIG. 2, is held at a position (unlock position) which covers the lock indication portion 21 substantially flush with the front surface of the mounting projecting portion 20. Also, the shape of the lock holding member 19 extending from the lower surface thereof to the side surface thereof, in a state in which the lock arm 6 is in engagement with the male connector housing M side as shown in FIG. 6, is set so that it can be rotated in such a manner that it can be inserted between the mounting projecting portion 20 and the two projecting strip portions 16 with little clearance left between them. And, as the result that the lock holding member 19 is shifted to such rotated position (lock position), the lock indication portion 21 is exposed, while the whole lock arm 6 is prevented from being flexed downwardly. As shown in FIG. 5, on the wary to the engagement between the two connector housings F and M, in order to avoid interference between the lock holding member 19 and the two projecting strip portions 16 when the lock arm 6 is flexed, there is formed a cutaway portion 24 in the lower portion of the back surface of the lock holding member 19.

Next, description will be given below in detail of the operation and effects of the present embodiment structure in the above-mentioned manner. To engage the female and male connector housings F and M with each other, with the lock holding member 19 remaining set at the unlock position, the female connector housing F is pressure fitted with the male connector housing M while it is matched to the hood portion 1 of the male connector housing M. In this operation, the two guide projecting portions 13 are gradually fitted into their respective positioning groove portions 3, thereby guiding the two connector housings into their mutual fitting operation. Also, when the fitting operation is performed, as shown in FIG. 5, the two slide projecting pieces 9 of the lock wall 4 are guided into the clearances included in the two side portions of the lock arm 6 and, at the same time, the leading end edge of the lock wall 4 is brought into sliding contact with the inclined surface 18 of the lock projecting portion 7 and the whole lock arm 6 is thereby flexibly deformed downwardly. In this case, the cutaway portion 24 formed in the lock arm 6 prevents the lock arm 6 from interfering with the two projecting strip portions 16.

And, when the two connector housings F and are in complete engagement with each other, the female and male terminals (not shown) thereof are electrically connected with each other and, on the other hand, as shown in FIG. 6, the lock arm 6 returns elastically and the lock projecting portion 7 is secured to the opening edge of the window portion 5. After then, if an operator rotates the lock holding member 19 about the rotary shaft 23, then the lock holding member 19 is shifted from the unlock position to the lock position. Due to this, the lock holding member 19 is inserted downwardly of the mounting projecting portion 20, is contacted with the two projecting strip portions 16 and is interposed between the projecting strip portion 16 and the mounting projecting portion 20 in such a manner that it fills up the clearance between them, thereby preventing the lock arm 6 from being flexed downwardly. That is, since the engagement between the lock projecting portion 7 and the opening edge of the window portion 5 is kept, even if an external force in the unlock direction is applied to the lock arm 6, the locking state of the two connector housings F and M can be surely kept.

Also, since the lock indication portion 21 is exposed as the lock holding member 19 is rotated and also since the lock indication potion 21 is colored with a color which can be seen conspicuously from outside, the operator or the like is surely able to confirm visually that the two connector housings F and M are in complete engagement with each other.

On the other hand, when the two connector housings F and M are in half-engagement or in complete engagement with each other, as shown in FIG. 5, the lock arm 6 is flexed downwardly and, between the mounting projecting portion 20 and the projecting strip portion 16, there is not present such a clearance as permits the rotation of the lock holding member 19. Due to this, even if trying to rotate the lock holding member 19, the back surface portion of the lock holding member 19 is sure to interfere with the projecting strip portion 16, thereby preventing the lock holding member 19 from rotating any further. The operator has noticed that the two connector housings M and F are in the half-engagement state. Therefore, the two connector housings M and F can be forcibly fitted with each other again, which can eliminate a possibility that the two connector housings M and F can be delivered to the following step while they remain in the semi-engagement state.

An operation to disconnect the two connector housings F and M from each other is performed after the lock holding member 19 is returned from the lock position back to the unlock position to thereby allow the lock arm 6 to be flexibly deformed.

As has been described heretofore, according to the present embodiment, since the lock holding member 19 is mounted on the leading end of the lock arm 6 and is thus formed integrally with the housings, the present embodiment it excellent in handling. Also, due to the fact that the lock holding member 19 is mounted in a rotatable manner, that is, the lock holding member 19 need not be shifted in the longitudinal direction of the housings when it is operated, the dimensions of the housings in this direction can be shortened. Also, since the lock indication portion 21 can be exposed by rotating the lock holding member 19, an operator can confirm very easily whether the two connector housings are locked or not.

The present invention is not limited to the illustrated embodiment but, for example, the following modifications also fall within the technical scope of the present invention:

The mounting portion of the lock holding member 19 is not limited to the mounting projecting portion 20 of the lock arm 6 but, for example, the lock holding member 19 may be mounted on the protection projecting portion 14 or on the side wall surface of the clearance which is included between the two side portions of the lock arm 6.

The lock arm 6 on which the lock holding member 19 is to be mounted may be provided in the male connector housing instead of the female connector housing.

What is claimed is:

1. A connector comprising:

a first connector housing having a flexibly deformable lock arm;

a second connector housing having a lock portion elastically engageable with said lock arm when the two connector housings are completely engaged with each other; and a lock holding member rotatably mounted on said first connector housing, said lock holding member being movable between an unlock position to allow said lock arm to be flexed in an unlocking direction thereof and a lock position to inhibit said lock arm to be flexed in the unlocking direction; wherein the lock holding member is positioned below the lock arm when the lock holding member is in the lock position.

2. A connector as claimed in claim 1, wherein said lock holding member is rotatably mounted on a free end side of said lock arm and is structured such that, when it is situated at said unlock position, a lock indication portion formed in the free end portion of said lock arm is covered and, when it is situated at said lock position, said lock indication portion is exposed.

3. A connector as claimed in claim 2, wherein said lock arm includes a mounting portion to which the lock holding member is mounted, said mounting portion of which a back surface is an arc shape and a front surface is a cut-down shape at almost right angle.

4. A connector as claimed in claim 2, wherein said lock indication portion is colored with a different color from the remaining portions of the first and second housings.

5. A connector as claimed in claim 3, wherein said mounting portion includes a shaft which is integrally formed on the side surface of the mounting portion, to which said lock holding member is rotatably mounted.

6. A connector as claimed in claim 3, wherein said lock holding member has an arc shaped inner surface which corresponds to the back surface of the mounting portion.

7. A connector as claimed in claim 1, wherein said lock holding member is separate from said deformable lock arm.

* * * * *